United States Patent [19]

Jenkins et al.

[11] Patent Number: 4,632,470

[45] Date of Patent: Dec. 30, 1986

[54] REFRIGERATOR CABINET AND METHOD OF ASSEMBLY

[75] Inventors: Thomas E. Jenkins; Donald S. Cushing, both of Louisville, Ky.

[73] Assignee: General Electric, Louisville, Ky.

[21] Appl. No.: 749,821

[22] Filed: Jun. 28, 1985

[51] Int. Cl.[4] ..... F25D 11/00

[52] U.S. Cl. ..... 312/214; 29/526 R; 52/787; 312/236; 312/257 R

[58] Field of Search ..... 312/214, 257 R, 257 SK, 312/257 A, 257 SM, 263, 264, 265, 116, 296, 236, 140; 52/787, 821; 220/71, 73, 74; 411/531, 546; 29/526 R, 455 R, 464

[56] References Cited

U.S. PATENT DOCUMENTS

| | | | |
|---|---|---|---|
| 759,834 | 5/1904 | Steele | 312/257 R X |
| 1,008,075 | 11/1911 | Schaffert | 312/214 |
| 1,930,187 | 10/1933 | Abronski | 411/546 X |
| 2,317,296 | 4/1943 | Nofzinger | 312/257 R X |
| 2,675,687 | 4/1954 | Philipp . | |
| 2,912,294 | 11/1959 | Wells et al. . | |
| 2,957,196 | 10/1960 | Kreider et al. | 29/526 |
| 3,697,723 | 10/1972 | Winsler et al. . | |
| 4,040,694 | 8/1977 | Lascarrou | 312/263 |
| 4,090,755 | 5/1978 | Johnson . | |
| 4,170,391 | 10/1979 | Bottger | 312/214 |
| 4,288,132 | 9/1981 | Znamirowski et al. . | |
| 4,348,068 | 9/1982 | Hawkins et al. | 312/257 R |
| 4,558,503 | 12/1985 | Wilson | 312/214 X |

FOREIGN PATENT DOCUMENTS

| | | | |
|---|---|---|---|
| 533367 | 7/1929 | Fed. Rep. of Germany | 312/263 |
| 1249478 | 9/1967 | Fed. Rep. of Germany | 312/257 R |
| 12351 | 3/1971 | Japan | 312/214 |
| 81957 | 12/1953 | Norway | 312/257 R |
| 861884 | 3/1961 | United Kingdom | 52/787 |
| 1296758 | 11/1972 | United Kingdom | 52/787 |

*Primary Examiner*—William E. Lyddane
*Assistant Examiner*—Thomas A. Rendos
*Attorney, Agent, or Firm*—Frank P. Giacalone; Radford M. Reams

[57] ABSTRACT

A refrigerator cabinet having an outer metal case including side walls and a top wall, a plastic inner liner and a partition separating a freezer and fresh food compartments and separate front door openings. A front face is formed along the front edge of the side walls and top wall defining the door openings. The front face along each side wall is provided with a first pair of vertically spaced openings arranged in the area adjacent the partition and a lower pair of vertically spaced openings arranged in the lower end of the front face. A support frame system is provided including vertically extending side support bars, each having pairs of vertically spaced upper and lower openings dimensioned to align with the upper and lower openings in the front face. An upper cross member extending between the side walls is positioned adjacent the front portion of the partition and a lower cross member extending between the lower edge portion of the side walls. The upper and lower cross members include a pair of vertically spaced openings adjacent each end thereof which are cooperatively arranged relative to the upper and lower pair of vertically spaced openings in the front face and support bar. Securing means cooperating with the aligned upper and lower pairs of vertically spaced openings in the front face, support bar and their respective cross members for securely holding the cross members substantially perpendicular relative to the cabinet side walls to thereby insure that the front door openings are maintained in a substantially square relationship.

8 Claims, 8 Drawing Figures

REFRIGERATOR CABINET AND METHOD OF ASSEMBLY

CROSS REFERENCE TO RELATED APPLICATIONS

This application is related to concurrently filed application bearing applicants' Ser. Nos. 749,801 Samuel J. Woolley and Thomas E. Jenkins, and 749,820 Thomas E. Jenkins and Robert R. Sisler, each assigned to the General Electric Company, the assignee of the present invention.

BACKGROUND OF THE INVENTION

In the construction of a household refrigerator it is often desirable to provide a partition within the refrigerator for separating the refrigerator into first and second compartments such as a freezer compartment and a fresh food compartment. It is further desirable to have the partition constructed in such a manner that there is a mullion across the front of the partition and secured to the cabinet outer case to afford a pleasing appearance. The freezer and fresh food compartments are in many cases closed by separate access doors which are hingedly attached to the cabinet outer case. For the pleasing appearance of the mullion and the proper fit of the doors for the freezer and fresh food compartments it is important that the width of the refrigerator cabinet be maintained and that the loads on the door do not produce excessive deflection of the structure, and further that the door openings are square and more importantly remain square under normal or design loads.

Generally household refrigerators normally employ a sheet metal outer casing and an inner liner with a resin foam insulation medium interposed therebetween. The foam or polyurethane compositions in liquid/gas form are introduced into the space between the outer casing and inner liner, expand throughout the space and then are solidifed by curing. In practice this solid foam which inherently adheres to both the outer case and inner liner adds a ridigity to the cabinet structure. This added rigidity by the employment of foam insulation has enabled manufacturers to reduce the thickness of the cabinet outer shell. In some instances the cabinet will deflect due to uneven floors or the force placed on the cabinet by weight of the doors. This deflection can cause a misalignment of the door wherein proper closure of the cabinet is impossible. It has been determined that when a cabinet deflects due to its being positioned on an uneven floor or excessive door loading the foam insulation which adheres to both the outer case and liner creeps or distorts. When this occurs the foam insulation over a period of time will set in its distorted position thereby causing the cabinet deflected to form a permanent parallelogram as the cabinet conforms to the floor.

This problem is further present when the refrigerator door is dimensioned relative to the cabinet to carry relatively large items such as one gallon milk containers and other large items. These larger items may present a weight increase of 50% over customary doors, and when stored on the door shelves can exert a large force on the hinge side of the cabinet. This force when excessive together with an uneven floor can cause the hinge side of the cabinet to sag and the cabinet frame to deflect and form a parallelogram. In this situation the door would be difficult to close and in some cases impossible.

Accordingly, by the present invention means are provided to insure that the cabinet door openings remain square under the forces applied by the weight of the doors on the cabinet frame and uneven floors.

SUMMARY OF THE INVENTION

By the present invention there is provided a refrigerator cabinet of the type having an outer metal shell with side walls interconnected by a top wall and a front face in which an inner liner and a partition separating a freezer and fresh food compartments is arranged. In carrying out the present invention the outer cabinet was constructed of pre-painted metal having a thickness of between 0.019 and 0.021. The front face is formed to include spaced first and second wall portions which are parallel to the front face. The front face and first wall portions are provided with pairs of upper and lower vertically spaced aligned apertures.

Mounting brackets having upper and lower vertically spaced apertures therein are arranged between the front face and the first wall adjacent each side wall so that the apertures in the mounting brackets align with the upper and lower aligned apertures in the front face. An upper metal cross member having vertically spaced fastener opening at each end thereof being spaced a distance such that they communicate with the upper pair of vertically spaced aligned apertures, and a lower metal cross member having vertically spaced fastener openings at each end thereof being spaced a distance sufficient to align with the lower pair of vertically spaced aligned apertures on the front face of the outer shell. Securing means insertable through the pairs of aligned apertures to secure the cross members perpendicular to mounting brackets and the cabinet front face to thereby insure that the side walls and cross members defining the front door openings are maintained in a substantially square relationship.

DESCRIPTION OF THE PREFERRED EMBODIMENT

Figure 1:
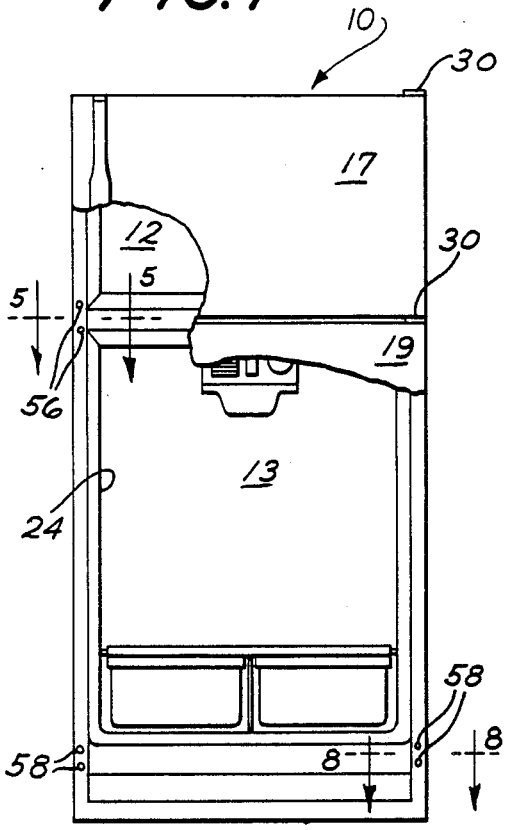
FIG. 1 is a front elevational view of a refrigerator incorporating the present invention.
Figure 2:
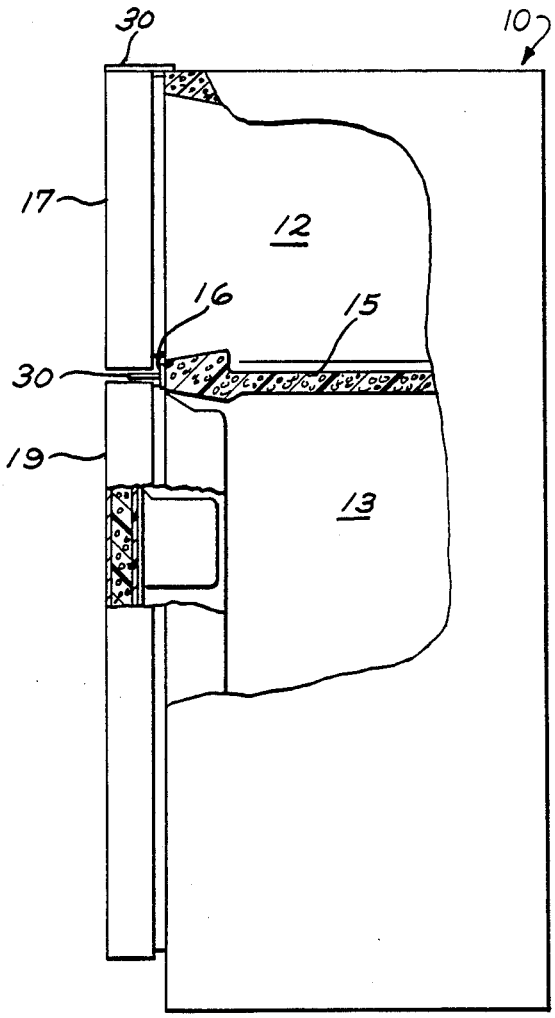
FIG. 2 is a side elevational view of the refrigerator.

Referring to FIGS. 1 and 2, a refrigerator 10 such as a top mount household refrigerator, for example, one having a freezing compartment 12 and a fresh food compartment 13 separated by an insulation partition assembly 15. Positioned in front of the insulation partition assembly 15 is a mullion component cross member 16 which, as will be explained fully hereinafter, insures the proper orientation of the side walls and reduce deflection of structure due to door loads of the cabinet. The partition assembly 15 and the manner in which it is assembled to the cabinet is fully disclosed and described in pending application for patent Ser. No. 622,257, filed June 19, 1984, Arthur C. Wilson, assigned to General Electric Company, the assignee of the present invention. The partition does not form a part of the present invention and accordingly will not be described in detail herein. Upon completion of the assembly of the refrigerator the freezer compartment and fresh food compartments would have separate doors 17 and 19 respectively for closing the respective compartments. The refrigerator 10 (FIG. 3) has a cabinet outer metal case or shell 18 that has opposite side walls 20, 22, a top wall 23, and a bottom wall 25 which envelopes both the freezer and fresh food compartments. The outer metal shell 18 has an interior liner 24 (FIG. 1) which is made of sheet metal or plastic material. Between the inner liner 24 and outer metal shell 18 (FIG. 5) there is insulation 27. This insulation in many refrigerators consist of polyurethane foam which is in liquid form and inserted or injected into the space between the outer metal shell 18 and the interior liner 24 and then cured in place. During the polyurethane foaming operation the outer metal shell 18 may bulge or bow outwardly and thus cause some distortion of the side walls 20 and 22 of the outer metal shell 18. It is desirable that the bowing or bulging of the outer shell when it occurs be corrected and eliminated prior to the final assembly of the refrigerator so that the insulation partition assembly 15 fits correctly relative to the side walls of the liner 24 with no gaps between those compartments. Moreover, when the doors 17 and 19 of the freezer compartment and fresh food compartment are hung it is again important that the case dimensions from one side 20 to the other side 22 be the same throughout the height of the refrigerator and that the door openings defining the freezer and fresh food compartment remain square so that the doors align and seal the front openings to the compartments 12 and 13 correctly.

Figure 3:
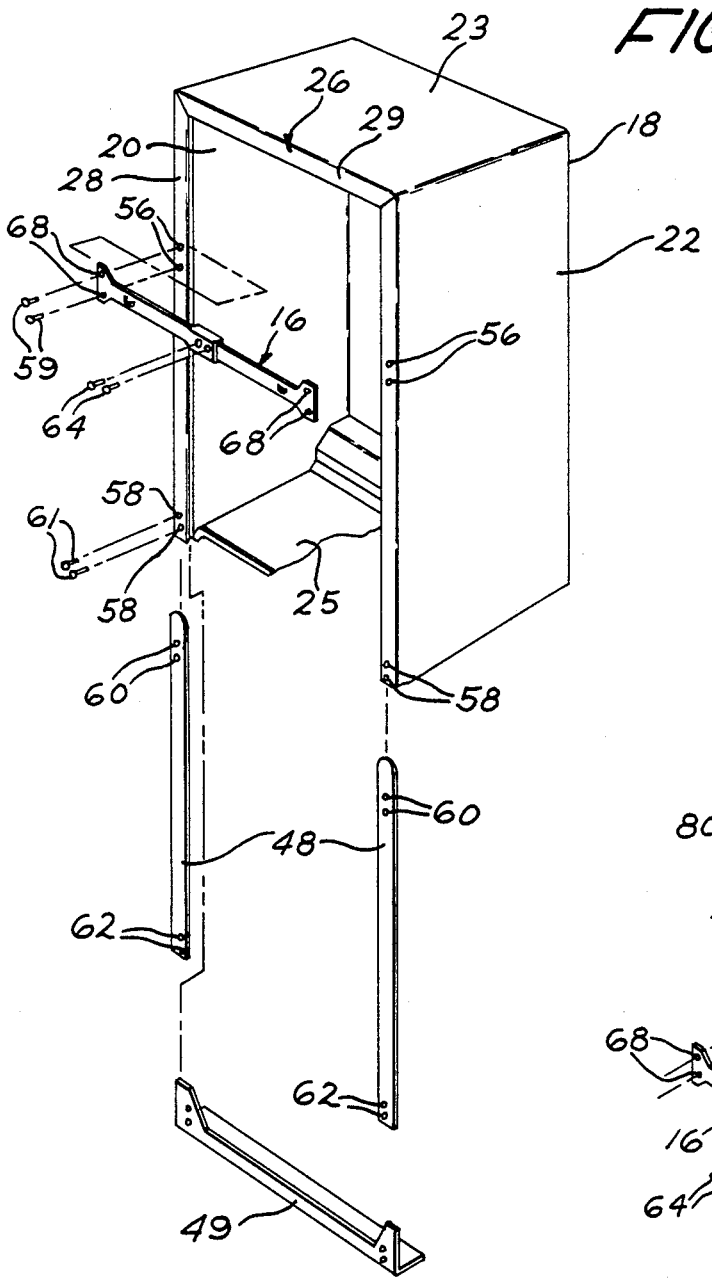
FIG. 3 is an exploded perspective view of the refrigerator cabinet showing parts of the present invention prior to assembly.
Figure 4:
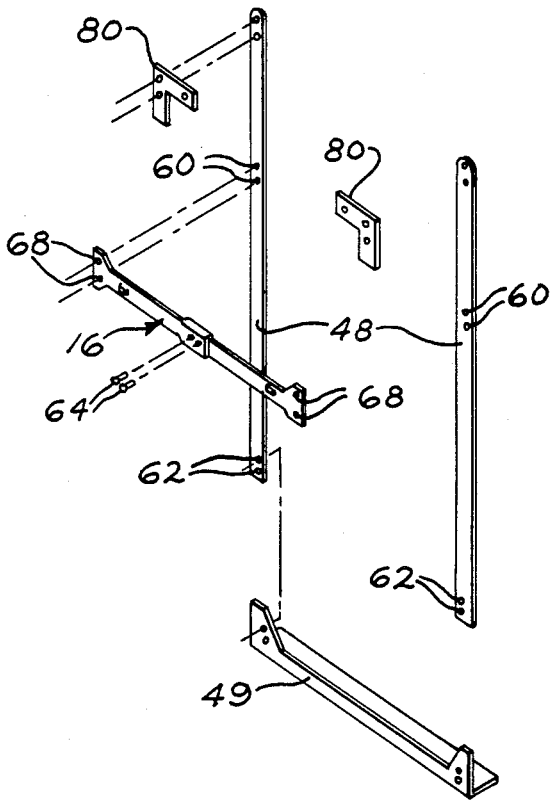
FIG. 4 is a perspective view showing another embodiment of the structure emboding the present invention.
Figure 5:
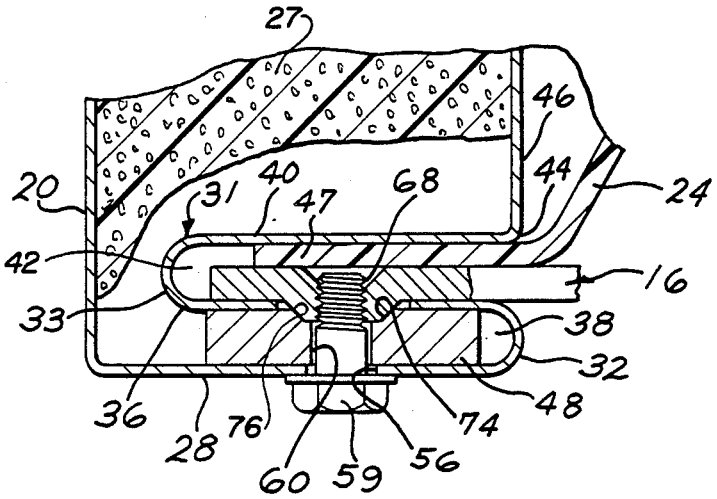
FIG. 5 is a sectional plan view taken along line 5—5 of FIG. 1 showing the assembly of the present invention.
Figure 7:
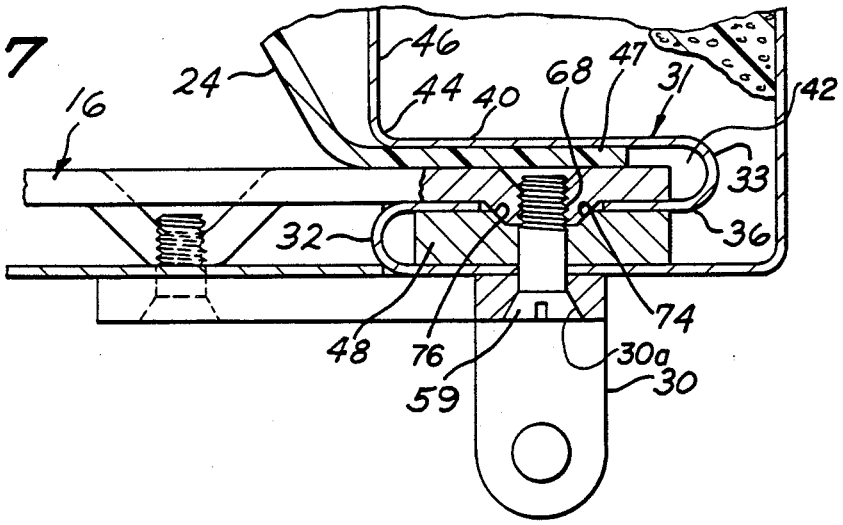
FIG. 7 is a sectional plan view taken along line 7—7 of FIG. 6.

With particular reference to FIGS. 3–5, the components and their arrangement involved with the method of assembling the refrigerator cabinet will be discussed. Prior to the foaming operation to provide the insulation between the outer metal shell 18 and interior liner 24, the outer shell is formed to provide a front face 26. The front face extends along both side walls and includes side wall portions 28 interconnected by a top wall portion 29 against which the doors of the freezer and fresh food compartments would engage and seal. While the hinges 30 for the doors in the present embodiment are shown mounted on the right hand side of the cabinet as viewed in FIG. 1 they may be mounted on either of the side wall portions 28. The outer shell 18 in the present embodiment is fabricated from pre-painted metal having a thickness generally between 0.019 and 0.021. This use of relatively thin sheet metal in some instances requires that means be incorporated in the cabinet construction which will insure against cabinet deflection. The cabinet door openings defined by front face 26 partition 15 may distort out of square if one of the side portions of the cabinet sags relative to the other. This relative vertical movement of one side portion relative to the other results in the front face forming a parallelogram. A side portion may sag for example when forces are exerted on the cabinet when it is placed on an uneven floor or when an excessive weight is placed on the door wherein the hinge side of the cabinet will sag. This is especially true in cabinets having relatively deep door shelves that are designed to hold heavy items such as one gallon milk containers or the like. Formed relative to the front face 26 of the cabinet and more particularly the side wall portions is a flange 31 depending rearwardly from the front face 26 which has an S shape. The flange 31 includes a first reverse bend 32, a second reverse bend 33, providing a first wall portion 36 and recess 38 between front face 26 and wall 36 and second wall portion 40 and recess 42 between wall 36 and wall 40. Each of the walls 36 and 40 being substantially parallel to front face 26. A right angle bend 44 at the end of wall 40 provides a rearwardly extending wall 46. The wall 46 is spaced from the side walls 20, 22 to allow the foam insulation 27 to have access to that area of the outer case. Prior to the foaming operation the liner 24 is arranged in the cabinet in spaced relationship to the outer walls thereof with the peripheral edge 47 of the interior liner 24 inserted into recess 42 as shown in FIGS. 5 and 7.

In accordance with the present invention means are provided to strengthen the cabinet relative to the front face and more particularly the area defining the door openings. To this end, a support frame (FIG. 3) is assembled to the front of the cabinet which includes the upper cross member 16, a pair of vertical mounting brackets or bars 48 and a lower cross member 49.

The pair of mounting bars 48 which are a strong rigid metal strip are, as shown in FIGS. 4 and 5, located in the recess 38 between the front face wall 26 and wall 36 of each side portion 28. The upper and lower cross members 16 and 49 as will be explained fully hereinafter are secured perpendicular relative to the mounting bars 48 and cabinet front face 26 in a manner which insures that they remain perpendicular to the side portions 28 of cabinet front face 26. This arrangement, as will be explained hereinafter, prevents deflection of the cabinet and insures that the door openings remain square. With reference to FIG. 3, it will be seen that the side front wall portions 28 are provided with upper and lower pairs of vertically spaced openings 56 and 58 respectively which are aligned with cooperating openings in the first wall 36. The mounting bars 48 are formed with vertically spaced pairs of upper and lower openings 60 and 62 which are spaced to align with openings 56 and 58 respectively when the bars are positioned in the recess 38 as shown in FIGS. 4 and 5. The bars 48 as will be explained below add considerable strength to the area where the mullion strip 16 and lower member 49 are connected to the side walls 20, 22 of the cabinet. Mullion component 16 and one of the mounting bars 48 as shown in FIG. 7 are used to mount the door hinges 30 arranged between the upper and lower doors. As thus far described the refrigerator cabinet with the mounting bars arranged with openings 60 and 62 aligned with openings 56 and 58 respectively is then processed through the insulation foaming operation. The bars 48 are dimensioned to take up the full width of the recess 38 so as to thereby prevent foam insulation from passing through openings 56, 58 as the foam expands into the area between wall 46 and side walls 20 and 22.

As mentioned above as a result of the foaming operation and its expansion through the area between the cabinet outer walls and the inner liner the cabinet may tend to bulge. That is, the side face walls 28 may deviate or bulge from their intended paralleled position and accordingly present a problem in properly fitting doors and other components necessary to complete the refrigerator. Further, the doors in the illustrative embodiment are relatively deep and are dimensioned to accommodate large items and accordingly it may be possible for the doors to be loaded so they will carry a considerable amount of weight and accordingly cause the cabinet side frame to sag. The sagging of the cabinet side wall under influence of door weight can cause the cabinet to distort from a square or rectangle to a parallelogram. It should be noted that the foam insulation generally adheres to both the inner liner and cabinet, accordingly if the cabinet deflects due to an uneven floor or excessive loading, the foam insulation will creep and distort. After a period of time the insulation will set in the distorted position causing the cabinet to permanently set in its deflected or distorted position.

To this end means are provided by the present invention to insure that the cabinet front face remain rectangular and that its side walls are positioned and maintained at the correct cabinet width with the door openings square. The mullion component 16 in the present embodiment as shown in FIG. 2 is two piece member joined at the center. The two piece arrangement facilitates the insertion of the end portion of component 16 into the recess 42 as shown in FIGS. 5 and 7. Once the end portions are positioned in the recess 42 the two pieces are then secured by fastening means 64 so the component 16 is maintained at its predetermined proper length. With component 16 fixed at its proper length the vertically spaced threaded openings 68 located adjacent each end are aligned with the vertically spaced apertures 56 so that the cabinet will be at its correct width. Mounting bar 48 at this point in time has been foamed into the cabinet with its vertically spaced pair of openings 60 and 62 aligned with the vertically spaced pair of openings 56 and 58 respectively. The component 16 is secured by threaded fasteners 59 which pass through openings 56 in wall 28 and openings 60 in mounting bar 48 to engage threaded openings 68 in component 16. As shown in the drawings the mounting bar 48 and wall portions 28 and 36 are sandwiched between the cross member 16 and fastener 59. This arrangement including the vertically spaced pair of openings secures the component 16 so that it will not pivot and remain perpendicular relative to the side wall of the cabinet under forces which may be applied thereto.

With reference to the door hinge bracket 30, it will be seen that the bracket 30 includes vertically spaced aperture 30*a* which align with the aperture in the cabinet side wall portion 28, 36, the aperture in cross member 16 and the aperture bar 48. Accordingly, as shown in FIG. 7 the door hinge bracket 30 is secured to the cabinet through the frame system of the present invention.

Figure 8:
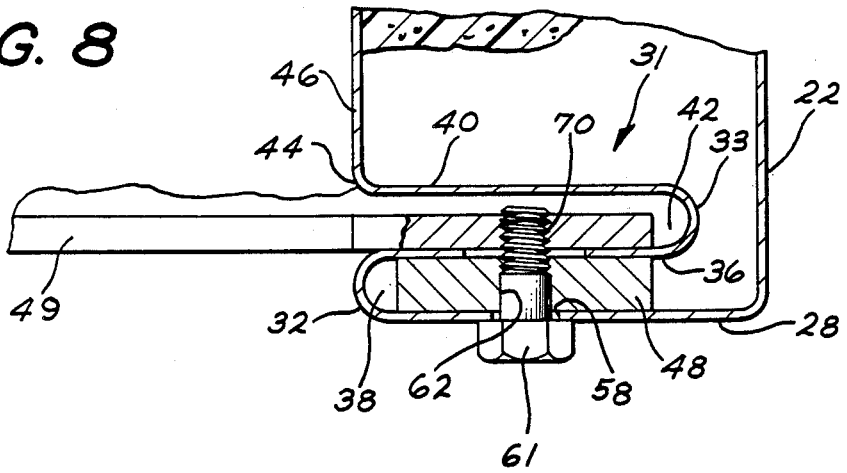
FIG. 8 is an enlarged sectional plan view taken along line 8—8 of FIG. 1 in the lower portion of the cabinet.

The lower cross member 49, as shown in FIG. 8, is secured to the outer surface of wall 28. The ends of the member 49 are provided with vertically threaded spaced openings 70 (FIG. 8) which align with openings 58 in the cabinet front, side wall 28 and openings 62 in the lower end of the bars 48. The lower cross member 49 is at this time secured to the cabinet by threaded fastening elements 61 which, like the action of fastener 59 described above, pass through openings 58 in cabinet wall 28 and openings 62 in mounting bar 48 to engage threaded openings 70 of member 49. As shown in the drawings the mounting bar 48 and wall portions 28 and 36 are sandwiched between the cross member 16 49 relative to the mounting bars 48 and wall portion 28 of the front face together in a manner which prevents pivoting of the member 49 relative to the cabinet side walls. By vertically spacing each cooperating pairs of apertures 56,58 of cabinet walls 28, 60,62 of mounting bars 48 and 68,70 of cross members 16 and 49 respectively as described above, pivoting action of either the mullion component 16 or cross member 49 relative to the cabinet front face is prevented. As long as members 16 and 49 remain perpendicular to the side walls the cabinet will not deflect. Means are further provided to insure that movement between the fastening element 61 and the apertures it passes through is minimized.

Referring to FIGS. 5 and 7, it will be seen that the area adjacent the openings 68 are formed with a projecting chamber 74. As the fastening elements 59 and 61 respectively are tightened the chamfer 74 is drawn and indexed into a recess 76 formed in the area adjacent the openings 60 and 62 in bars 48. This indexing action afforded by the chamfer 74 and recess 76 locks the components against pivoting action to thereby prevent cabinet deflection.

Figure 6:
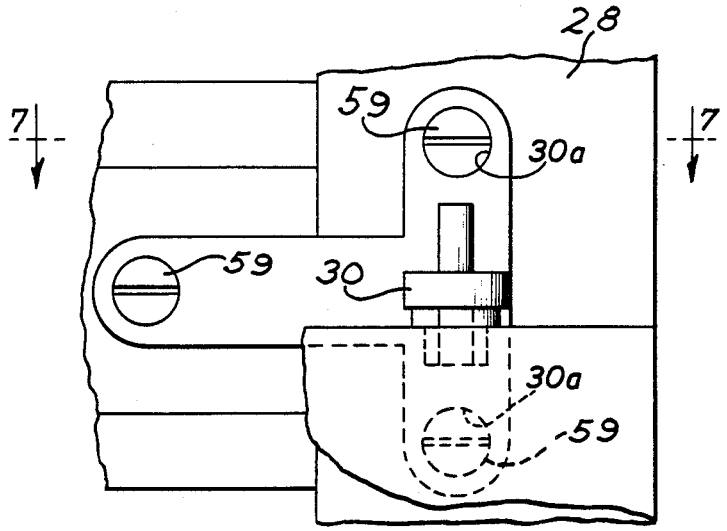
FIG. 6 is an enlarged front elevational view showing the hinge area between the door of the cabinet.

As best seen in FIGS. 6 and 7 the mounting bars 48 are employed to mount the central hinge 30 to the cabinet. In this instance the fasteners 59 pass through openings in the hinge plate so that they are secured to the cabinet through the frame system of the present invention.

In certain cabinet configurations depending on the distance between the cross member and cabinet top wall, it may be advantageous to provide corner brackets 80 as shown in FIG. 4 to further insure the integrity of the cabinet. In still further configurations depending on cabinet size and the thickness of the steel used in fabricating the outer case, it may be appropriate to extend the support bars as shown in FIG. 4 to the upper corner where they may be secured to the brackets 80. In this instance both the freezer compartment 12 and fresh food compartment would in effect be provided with a strengthening frame.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. A method of assembling a refrigerator cabinet of the type having an outer metal shell with side walls connected by a top wall forming upper front corners and a front face adjacent each of said walls, an inner liner and a partition separating a freezer and fresh food compartments comprising:

forming said front face to include spaced first and second wall portions parallel to said front face;

providing a first pair of vertically spaced aligned apertures in each of said front face and said first wall portion adjacent said partition;

providing a second pair of vertically spacec aligned apertures in said front face and said first wall portion adjacent a lower portion of said cabinet;

forming a first metal cross member having a pair of vertically spaced fastener openings at each end thereof spaced vertically apart a distance such that when said fastener openings are aligned with said aligned apertures adjacent said partition said outer metal shell will have the correct cabinet width;

forming a second metal cross member having a pair of fastener openings at each end thereof dimensional to align with said apertures in the lower portion of said cabinet;

inserting a support bar having a pair of upper and lower vertically spaced apertures therein between said front face and said first wall adjacent each side wall such that the apertures in each of said support bars communicate with said associated aligned apertures in said first wall portion and said front face; and securing said first and second cross members to said front face adjacent said partition and said lower portion of said cabinet respectively by drawing said cross members, support bar, first wall portion and front face together to form a locked joint between said cabinet front face adjacent said first and second pair of aligned apertures and said first and second metal cross members respectively, whereby said cabinet side walls and said cross members are maintained in a substantially square relationship.

2. The method of assembling a refrigerator cabinet as recited in claim 1 further forming projecting chamfers adjacent the vertically spaced pair of fastener openings in one of said cross members; and forming recesses adjacent one of said pair of vertically spaced apertures in said support bars for receiving said chamfers.

3. The method of assembling a refrigerator cabinet as recited in claim 2 further including the step of providing a corner bracket secured in each of the upper front corners of said cabinet, each said corner bracket including a leg portion arranged adjacent said first wall portions of said cabinet.

4. The method of assembling a refrigerator cabinet as recited in claim 3 further including the steps of providing said support bars with elongated mounting brackets which extend upwardly to engage said corner brackets; and;

securing said leg portion of each of said corner brackets to said elongated mounting brackets to thereby provide a frame surrounding both of said freezer and fresh food compartments.

5. A refrigerator cabinet of the type having an outer metal shell with side walls connected by a top wall forming upper front corners and a front face, an inner liner and a partition separating a freezer and fresh food compartments;

said front face including inwardly extending parallel side wall portions connected by a top wall portion;

said side wall portions each being bent upon itself to provide a first wall portion forming a first recess between said side wall portion and said first wall portion and a second wall portion forming a second recess between said first and second wall portions;

said side wall portions and said first wall portions having a first vertically spaced pair of aligned apertures generally located in the area of said partition, and a second pair of vertically spaced aligned apertures arranged in a lower end of said side wall portions and said first wall portions;

a frame structure including an elongated mounting bracket arranged vertically in said first recess between each of said side wall portions and said first wall portions, including a pair of vertically spaced openings at each end communicating with said pairs of vertically spaced aligned apertures in said side wall portions and said first wall portions of said front face;

a first cross member having end portions arranged in said second recesses including a pair of fastener openings in each end portion spaced vertically apart a distance such that when aligned with said first vertically spaced pair of said aligned apertures said outer metal shell will have the correct cabinet width;

a second cross member extending between said side wall portions including a vertically spaced pair of fastener openings in each end thereof spaced to align with said second pair of vertically spaced aligned apertures;

securing means insertable through said vertically spaced apertures for drawing said cross member and elongated mounting brackets relative to said first wall portions and said side wall portions for securely holding said cross members substantially perpendicular to said side walls to thereby insure that said cabinet side walls are maintained in a substantially square relationship.

6. The refrigerator cabinet as recited in claim 5 wherein a chamfers are formed adjacent the fastener openings in one of said cross members and recesses are formed adjacent the openings in said mounting brackets for receiving said chamfers.

7. The refrigerator cabinet recited in claim 6 wherein a corner bracket is secured in each of the upper front corners of said cabinet, each of said corner brackets including a leg portion arranged adjacent said side wall portions of said cabinet.

8. The refrigerator cabinet recited in claim 7 wherein said elongated mounting brackets extend upwardly to engage said corner brackets, means securing said leg portions of said corner brackets to said elongated brackets to form a frame surrounding both of said freezer and fresh food compartments.

* * * * *